US006804980B2

(12) United States Patent
Bulle

(10) Patent No.: US 6,804,980 B2
(45) Date of Patent: Oct. 19, 2004

(54) METAL STOCK BENDER TWISTER ADAPTOR

(76) Inventor: Marshall R. Bulle, P.O. Box 340, Rye, CO (US) 81069

( * ) Notice: Subject to any disclaimer, the term of this patent is extended or adjusted under 35 U.S.C. 154(b) by 173 days.

(21) Appl. No.: 10/272,695

(22) Filed: Oct. 16, 2002

(65) Prior Publication Data

US 2004/0074276 A1 Apr. 22, 2004

(51) Int. Cl.[7] ..... B21B 15/02
(52) U.S. Cl. ..... 72/64; 72/219; 72/458
(58) Field of Search ..... 72/64, 217, 218, 72/219, 320, 321, 371, 387, 388, 458

(56) References Cited

U.S. PATENT DOCUMENTS 2,412,795 A * 12/1946 Abrahamsen ..... 57/1 R
2,929,434 A * 3/1960 Barnes ..... 72/319
4,026,137 A * 5/1977 Scroggins ..... 72/299
4,601,187 A * 7/1986 Johnson et al. ..... 72/64
5,107,694 A * 4/1992 Kemp ..... 72/64
5,626,045 A 5/1997 Bulle ..... 72/219

* cited by examiner

*Primary Examiner*—Ed Tolan
(74) *Attorney, Agent, or Firm*—Nawrocki, Rooney & Sivertson, P.A.

(57) ABSTRACT

Adaptor and twister apparatus, which adapts an existing bender apparatus to also twist vertically oriented metal stock, is provided. Removing the alternate function's parts avoids interaction between them. The twister has an adjustable clamp which grips the supporting pedestal, having an attached adjustable stock bottom locator. A vertical opening in the adaptor offset from the pedestal receives stock to be twisted, and pivotably mounts a lever for twisting the stock. The stock extends along the side of the pedestal through the lever, the vertical opening and the clamp. Vertical aligned holes in the clamp and the lever, which are also aligned with the vertical opening in the adaptor, are arranged to grip the stock cross-section, which results in only the stock between these parts being twisted. The location of the clamp and bottom locator can be changed to adjust the length and the location of the twisted portion.

5 Claims, 5 Drawing Sheets

METAL STOCK BENDER TWISTER ADAPTOR

FIELD OF THE INVENTION

This invention relates to improvement to an existing manual metal stock bender to additionally provide the ability to twist square or flat metal stock.

BACKGROUND OF THE INVENTION

A metal stock bender using manual power is available which provides a means of bending stock metal of various shapes around a die in the horizontal plane to produce a shape conforming to the exterior of the die. A twisted shape can not be produced using this bender, or any other bender, because only one revolution can be made around the centered die required to provide the desired bend shape. Since the manual stock bender requires a sturdy pedestal to provide horizontal bending around a die which takes up a considerable amount of room, it would be desirable if the apparatus attached to the pedestal could be adapted to alternately attach either the bender apparatus or twister apparatus. Adding a twister function would minimize shop space at a minimum cost for these two functions.

SUMMARY OF THE INVENTION

U.S. Pat. No. 5,626,045 is hereby incorporated by reference. The instant invention provides an improvement for this invention, which provided a metal bending function. The instant invention substitutes adaptor apparatus for the previous apparatus attached to the top of the pedestal and includes twister apparatus, being arranged such that either metal bending or metal twister operations can be provided by this one apparatus.

Adapting the above bender to also provide the twister function, not only includes adding twister elements, but also requires that the bender and twister functions do not interfere with one another. When twisting metal stock this is accomplished here by providing the twister parts and removing those bender parts which would interfere with the twisting operation, and alternately when bending metal this is accomplished by removing all of the twister parts while providing all of the bender parts. This eliminates any possibility of interference between the parts used for bending with those used for twisting. These changes must be both easy and rapid for this dual use to be acceptable to a user. This goal is accomplished as described below.

The adaptor apparatus primarily consists of an upper and a lower vertically stacked adaptor plate. These plates are spaced apart by cylindrical shaped spacers and attached to a top plate which is welded to the pedestal. These adaptor plates provide essentially the same forming die holder arrangement as before, including the plates having aligned extensions with multiple pairs of aligned holes to pivotably secure various sized dies which was provided by the U-shaped forming die holder before. The lower plate also has a circular shape, with a number of stop holes about the periphery encircling the die holder as before. The end opposite to the adaptor plates is arranged to secure the slide bar in the same attitude with respect to the other parts of the bender apparatus as before. The adaptor plates also provide the same attachment locations and multiple holes for the bending apparatus as before.

A vertical cylinder, offset from the pedestal, is attached through the plates to provide a vertical twister pivot hole.

The bender apparatus does not utilize this twister pivot hole. This arrangement, with the cylinder located within the plates, ensures that the cylinder does not interfere with the bender operation. All of the movable bending parts are attached to the adaptor apparatus or to each other are attached by removable pins as before. The slide bar of the bender apparatus, which is fixed in position, extends into a slot in the cylinder and is attached through holes in the opposed adaptor plates by a single bolt. The bolt also extends through centering bushings mounted on opposite sides of the bar.

The above arrangements provide for quick attachment and removal of the bender parts which could interfere with a twisting operation.

The twister parts include only a twister lever, a clamp and a bottom locator. The twister lever has a perpendicular extension from one end of made up of an inner and an outer cylindrical shaped portions. The inner portion is solid with a centered hole arranged to grip the cross-section of stock which extends through the hole. The outer portion is coaxial with the inner portion and in the form of a cylindrical shaped shell. The outer portion is larger than the hole through the inner portion but smaller than the inner portion which provides a ledge between the inner and the outer portion. The outer portion is sized to mate with the cylinder through the adaptor. This provides a pivotal attachment of the lever with the cylinder with the ledge between the two portions supporting the lever, and allows the lever to rotate without interference in the horizontal plane. The hole through the inner portion of the lever extension is arranged to grip the cross-section of either square of flat metal stock to be twisted which extends through the hole. This permits the lever to engage and twist stock extending through the lever extension.

The clamp is arranged to grip the pedestal, and is adjustable to permit installing or removing the clamp. The clamp has an opening identical to that through the lever arranged such that the stock extending downward past the clamp has its cross-section gripped by the clamp.

The bottom locator consists of a rod with a perpendicular "foot" extension from one end of the rod. The rod is slideably attached to the clamp parallel to the pedestal and can be locked in any desired location to permit locating the bottom locator's "foot" extension extending underneath and supporting the stock.

With the above arrangements, the stock is oriented vertically and located within the hole in the lever, the cylinder and the hole in the clamp, and supported by the bottom locator. With this arrangement, when the lever is rotated horizontally only that portion between the lever and the clamp is twisted, since only these parts grip the stock by its cross-section. The spacing of the lever and the clamp determines the twisted portion length, and the location of the bottom locator determines its location, The location of the clamp on the pedestal also determines the location of the range of adjustments that the bottom locator can provide.

As described above, all of the twister parts which include only a lever, a clamp and a bottom locator are easy to attach and detach from the adaptor and pedestal. If desired, the clamp and bottom locator can even be removed and attached as a unit. While removing the slide bar was indicated as being readily removable in the above description, this bar does not extend far enough to interfere with the twisting operation. Therefore at the option of the operator, the slide bar can be left in place during the twister operation and the other movable bender parts, including the slide lock be detached from the adaptor, since under some conditions the slide lock could interfere with the twister operation. This substitution of the parts required for the alternate bending and twisting operations eliminates any possibility of interaction between them.

DETAILED DESCRIPTION

Figure 1:
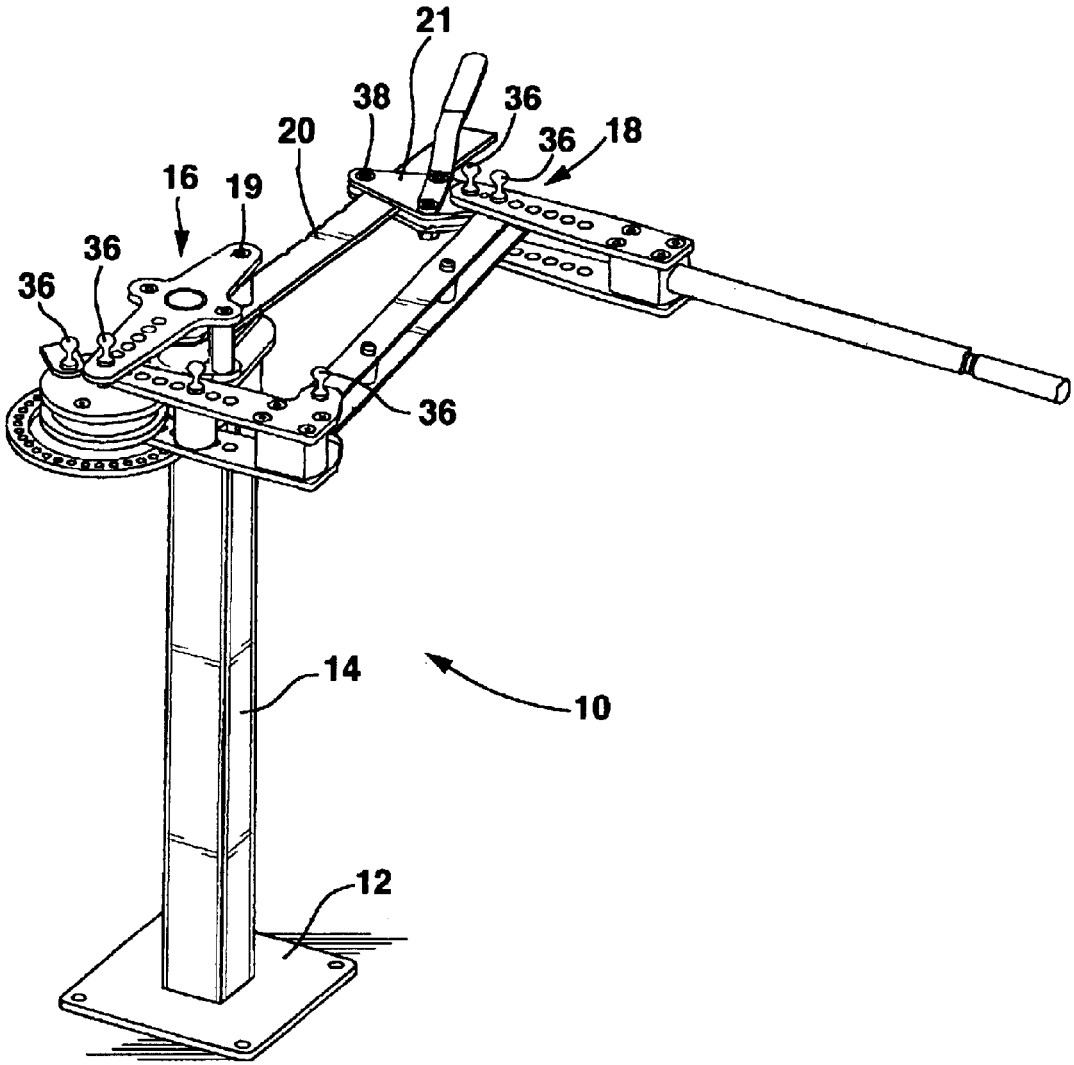
FIG. 1 shows the apparatus when adapted to bend stock.
Figure 2:
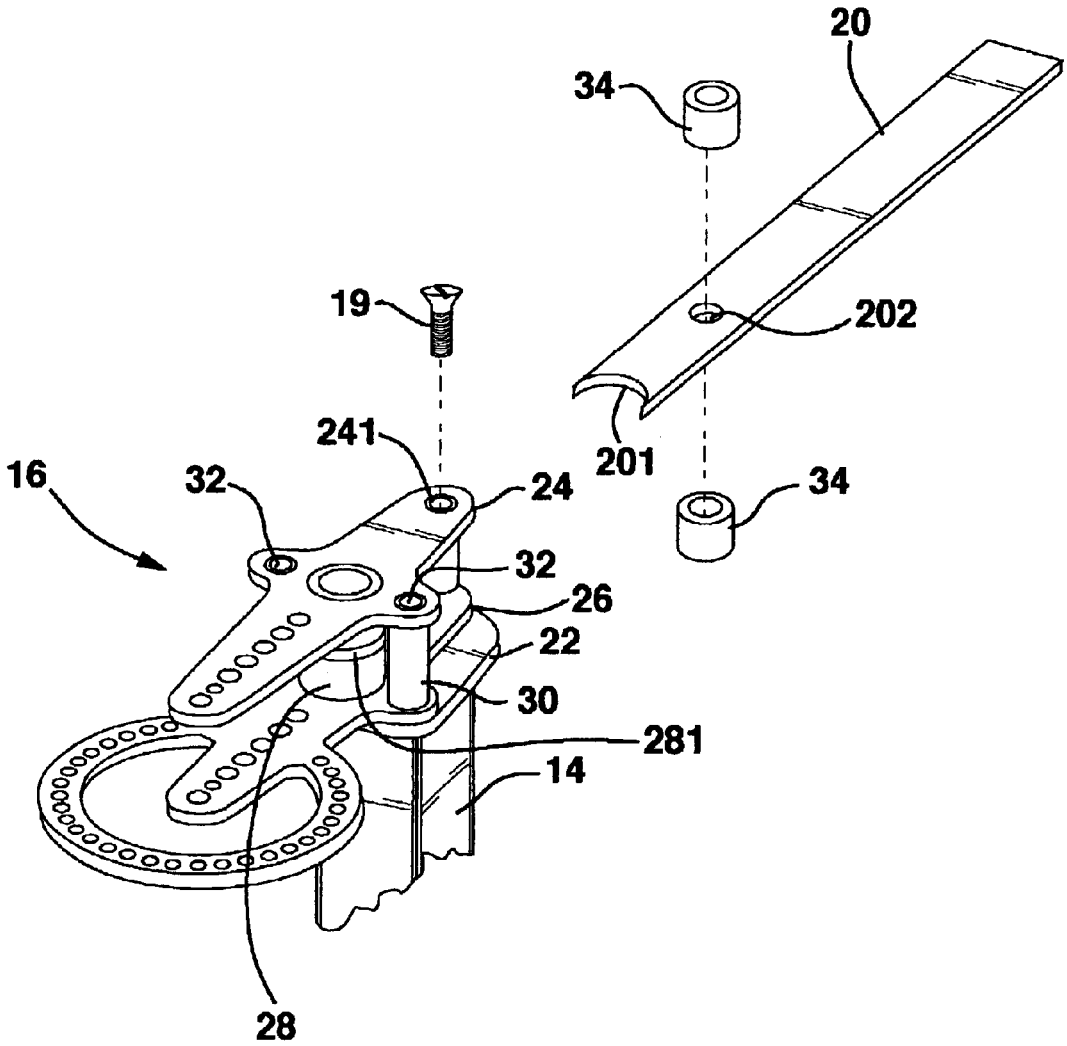
FIG. 2 shows a portion of the pedestal, the attached adaptor apparatus and an exploded view of the detached slide bar of the bender.

Bending apparatus 10 used for metal stock bending is shown in FIGS. 1 and 2. This shows a base 12 supporting a pedestal 14 and adaptor apparatus 16. Adaptor apparatus 16 is adapted to connect to both the bender and the twister parts. Compound lever mechanism 18 is arranged the same as in U.S. Pat. No. 5,626,045, which was incorporated by reference. Compound lever mechanism 18 is attached to adaptor apparatus 16 by only by bolt 19 and pins 36, as described further later.

Pedestal top plate 22 is welded to the top of pedestal 14. Adaptor apparatus 16 is made up of top adaptor plate 24, bottom adaptor plate 26 and a hollow cylinder 28. A pair of bolts 32 extend downward through holes in plate 24, through cylindrical shaped spacers 30 on each side of top adaptor plate 24, through holes in bottom adaptor plate 26, into mating threaded holes in pedestal top 22, which secures adaptor apparatus 16 to pedestal 14. Top adaptor plate 24 and bottom adaptor plate 26 together provide the same forming die holder arrangement with multiple pairs of opposed aligned holes to pivotably secure various sized dies as before. The opposite end of adaptor apparatus 16 is arranged to secure slide bar 20, as will be described later.

The ends of cylinder 28, which neck down slightly at each end, are secured by extending into mating holes in upper adaptor plate 24 and the lower adapter plate 26. Cylinder 28 has an centered groove 281 which receives the mirror shaped semi-circular concave end 201 of slide bar 20. The center of cylinder 28 provides an opening through which metal to be twisted can extend, as will be described later. End 201 of slide bar 20 is placed within groove 281, and held in place by a bolt 19 which extends through hole 241, through upper spacer 34, through hole 202 in slide bar 20, through bottom spacer 34, then into a mating threaded hole in bottom plate 26, which secures the slide bar in place. Pins 36 secures the remainder of the bender parts in place, as shown, through a selected one of the plurality of aligned pairs of holes shown in top adaptor plate 24 and bottom adaptor plate 26.

With this arrangement all that is necessary to remove the movable parts of the bender mechanism is to pull pins 36 to remove all of the bender parts excepting slide bar 20 and slide bar lock 38. Slide bar lock 38 is removed by simply sliding the lock outward from the end of slide bar 20. Even if not removed, slide bar lock 38 would not interfere with the twister operation, however slide lock 22 could be removed to avoid possible interference. To reassemble the movable parts of the bender, they are simply repositioned as shown in FIG. 1 and pins 38 reinserted. If slide bar 20 and spacers 30 were removed, bolt 19 must be reinstalled as shown through the mating parts. Slide bar lock 38 must also be installed on slide bar 20 before reassembling the bender apparatus.

FIGS. 3, 4, 5 and 6 show shows apparatus 40 as used for twisting stock metal. Base 12, pedestal 14, pedestal top 22 and adaptor apparatus 16 are the same as for the bender apparatus, however here the moveable bender apparatus, including slide bar 20, has been removed as described above.

Clamp 42 is essentially planar consisting of a planar extension 421 with two arms 422 extending outward in the same plane. A threaded rod 423 extends through opposed mating threaded holes in the ends of arms 422. Knob 424 is attached to the end of rod 423 to provide manual adjustment means to change the distance between arms 422. Hole 425 through extension 421 has a square opening with a superimposed slot. The square opening of hole 425 will engage square stock extending through the opening, and the slot will engage flat stock.

A threaded rod 426, extends through a threaded mating hole 426 into hole 427. Knob 428 attached to rod 426 provides manual adjustment of the location of the rod and secure bottom locator 44.

Twister lever 44 has a perpendicular cylindrical shaped solid first extension 441 and a smaller coaxial cylindrical shell shaped second extension 443 extending outward from the first extension. The difference in size between first extension 441 and second extension 442 provides a shoulder 444 at their transition. First extension 441 has a centered hole 442 along the cylinder axis one end which extends completely through the extension. Hole 442 is made up of a square opening and a superimposed slot opening and is identical to hole 425 through clamp 42. The Twister lever 44 has a handle 443 on the end opposite extension 441. Extension 443 fits within the vertical hole through cylinder 28 with shoulder 444 resting on its outer surface and the adjacent area of top adaptor 24 plate which pivotably supports lever 44. Placing extension 443 within the hole through cylinder 28 with shoulder 444 abutting cylinder 28 and top adaptor plate 24 is all that is necessary to attach twister lever 44 to adaptor apparatus 16.

Bottom locator 46 is formed from a rod 461 with an offset extension 462 forming an extending "foot" welded perpendicularly to one end.

Figure 3:
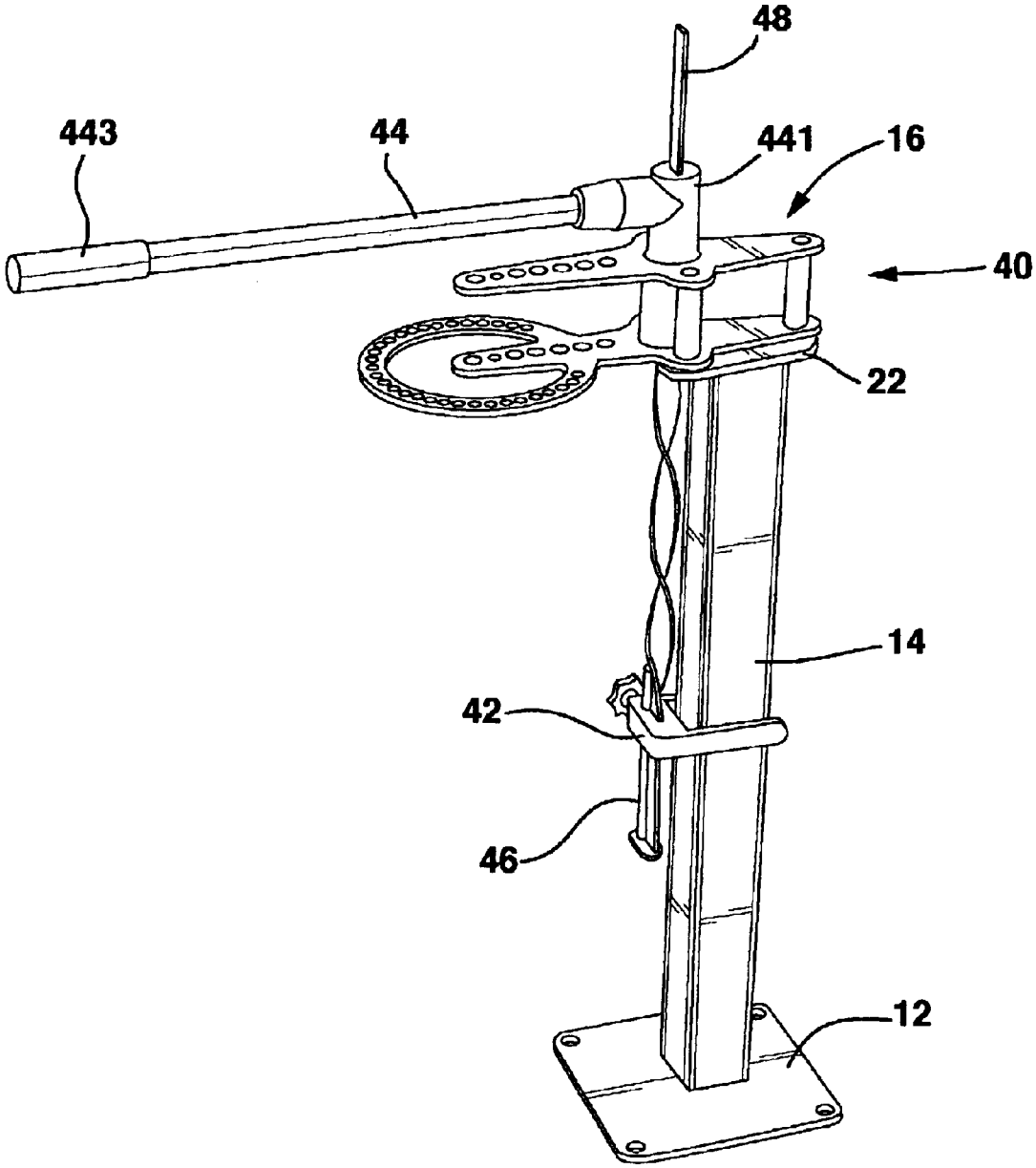
FIG. 3 shows the apparatus when adapted to twist stock.
Figure 4:
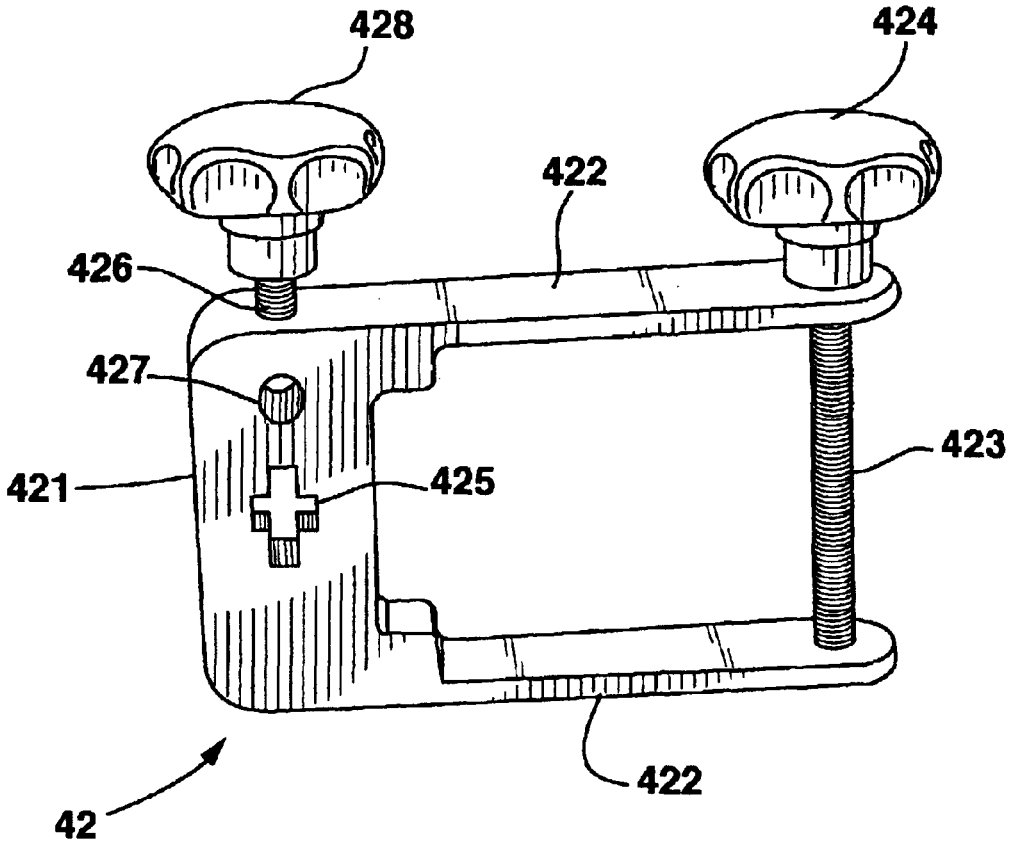
FIG. 4 shows the twister clamp.
Figure 5:
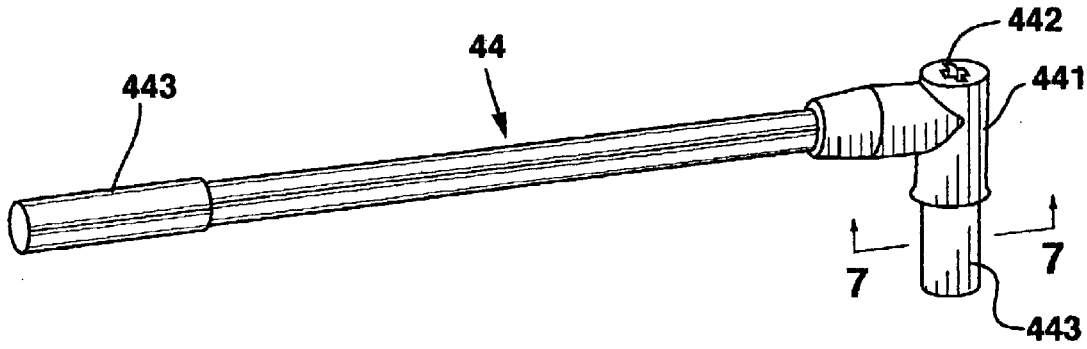
FIG. 5 shows the twister lever.
Figure 6:
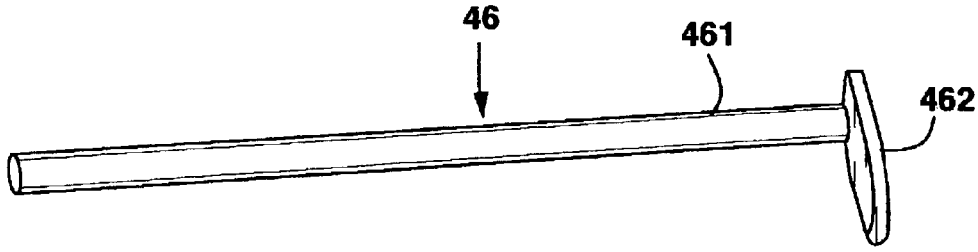
FIG. 6 shows the twister bottom locator.
Figure 7:
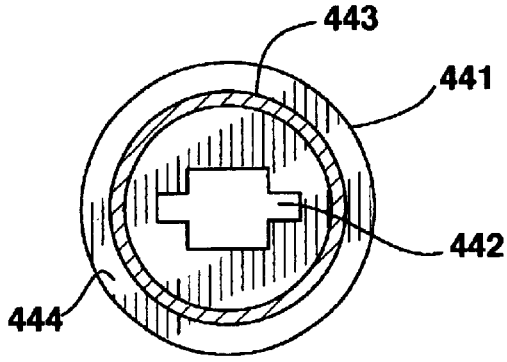
FIG. 7 shows cross-section view 7—7 of FIG. 5.

FIG. 3 shows the parts assembled on twister apparatus 40 with a length of flat stock 48 in place. Clamp 42 is attached gripping pedestal 14 by using knob 424 to draw arms 422 together, and bottom locator 46 is inserted within hole 427 in the clamp and secured by knob 428. With this arrangement extension 462 of bottom locator 46 can support downward extending stock 48. With this arrangement rotating twister lever arm 44 around pedestal 14 will twist stock 48, as shown, between clamp 42 and lever arm 44 because the shape of the holes will grip the stock.

The twister parts are removed by simply lifting lever arm 44 upward, using knob 428 to remove rod bottom locator 46 and using knob 424 to remove clamp 42. If desired, clamp 42 and bottom locator 46 can be removed as one unit.

As described earlier, since the handle and clamp are the only locations where the stock is gripped, only the material between these two parts will be twisted. Contrary to most people's expectation, the length of twisted stock is not shortened by being twisted. This permits the above arrangement for establishing the upper and lower twist limits to be accurate regardless of the number of twists.

Because stock metal to be twisted has a certain amount of "spring", a firm grip must be maintained on the twister lever while twisting stock, otherwise this spring effect of the twisted metal can be hazardous by unexpectedly rotating the twister lever back into the operator.

The horizontal rotation of the stock produced by a horizontally rotated twister handle, unlike bench mounted twisters, permits the operator to manually generate a much greater force, because here the operator can walk around the pedestal and lean his weight into the lever while forcing it around the twister pivot hole.

The ease and speed with which the parts for bending metal stock or for twisting metal stock can be substituted for each other, described above, permits the use of one pedestal 14 and added adaptor 16 to readily and easily provide alternately either a bending or a twisting function.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. In an apparatus for bending metal of the type including a) pedestal support means for supporting the apparatus;

b) forming die means for providing the bent metal shape;

c) roller die means pivotably mounted upon the pedestal means for bending metal around the forming die means; and d) compound lever means mounted on the pedestal for rotating the roller die means around the forming die means having means for adjusting the compound lever pivot point;

the improvement which comprises:

e) adaptor means, attached to the top of the pedestal support means, for alternately attaching the bending metal apparatus and attaching twisting apparatus, the adaptor means having a vertically oriented hollow cylinder extending therethrough which is offset from the pedestal means;

f) twister lever means pivotably mounted on the top of the adaptor means cylinder for twisting stock extending perpendicularly therethrough in an essentially horizontal plane, the lever means having a vertically oriented hole therethrough centered on the cylinder arranged to grip the cross-section of stock extending therethrough;

g) a manually attachable clamp means for gripping the pedestal means having a vertically oriented opening therethrough arranged to grip the cross-section of stock extending therethrough; and h) a manually adjustable bottom locator means attached to said clamp means for supporting the lower end of stock extending through the clamp means.

2. Apparatus as in claim 1 wherein said twister lever means means comprises a lever having a handle on one end and a perpendicular first and second cylindrical shaped coaxial extensions from the opposite end, the first portion being solid and extending outward from the lever which has a centered square opening with a superimposed slot shape arranged to grip the cross-section of both square and flat stock extending therethrough, with the second portion being smaller than the first portion such that a perpendicular inward extending shoulder extends inward between the first and second portions.

3. Apparatus as in claim 2 wherein said bottom locator means comprises a rod and a perpendicular extension attached to one end of the rod which extends perpendicularly and outwardly from one end of the rod.

4. Apparatus as in claim 3 wherein said clamp means comprises:

a) an essentially planar rectangular shaped extension having offset arms extending outwardly from a major side thereof in essentially the same plane as the extension, the arms having identical opposed and aligned threaded first and second holes at their ends;

b) a first threaded rod having a knob attached to one end thereof, sized to extend between and mate with the opposed first and second threaded holes in the arms;

c) a third hole perpendicular to and through the planar rectangular shaped part, which is sized to slideably receive the bottom locator rod;

d) a fourth threaded hole perpendicular to the third hole through the planar rectangular shaped part extending into the third hole; and e) a second threaded rod having a knob attached to one end thereof which mates with and extends into the fourth threaded hole.

5. Apparatus as in claim 4 wherein said adaptor means comprises:

a) a pedestal top plate attached to the top of the pedestal means;

b) a hollow cylinder having necked down opposite ends and having a centered groove around the periphery thereof;

c) a top adaptor plate and a bottom adaptor plate;

d) a pair of adaptor plate cylindrical shaped spacers, which are essentially the same length as the cylinder, said spacers having a hole therethrough aligned with the axis thereof;

e) bushing spacers for the slide bar;

e) the top adaptor plate and the bottom adaptor plate being spaced apart vertically with each having first and second extensions which extend outwardly respectfully in a first and an opposed second direction, the top adaptor plate and the bottom adaptor plate of the first extension having a plurality of aligned holes equally sized holes which provide die holder means for pivotably securing various sized dies, and the bottom adaptor plate of the first extension having circular shaped element which encircles the first extension with spaced apart holes to provide stops, the second extension top adaptor plate and bottom adaptor plate having aligned holes sized to receive a first bolt with the hole through the bottom adaptor plate being threaded such as to secure the bolt in place through the centered slide bar means and bushing spacers, the plates all being connected together by two bolts which flank the cylinder in a direction essentially perpendicular to the first and second directions, the bolts extending downward through aligned holes sized to receive the bolts in the plates in the sequence from and through the top adaptor plate, the cylindrical shaped spacers, the bottom adaptor plate and the pedestal top plate, with the holes through the pedestal top plate being threaded such as to engage the bolts and secure the plates and spacers in place.

* * * * *